US007686068B2

(12) United States Patent
Tholen et al.

(10) Patent No.: US 7,686,068 B2
(45) Date of Patent: Mar. 30, 2010

(54) BLADE OUTER AIR SEAL CORES AND MANUFACTURE METHODS

(75) Inventors: Susan M. Tholen, Kennebunk, ME (US); Paul M. Lutjen, Kennebunkport, ME (US); Richard H. Page, Guilford, CT (US); Richard W. Hoff, Glastonbury, CT (US); Roger J. Gates, West Hartford, CT (US); Michael F. Blair, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 440 days.

(21) Appl. No.: 11/502,046

(22) Filed: Aug. 10, 2006

(65) Prior Publication Data

US 2009/0301680 A1 Dec. 10, 2009

(51) Int. Cl.
*B22C 9/10* (2006.01)

(52) U.S. Cl. ..... 164/369; 164/35; 164/45; 164/516

(58) Field of Classification Search ..... 164/28, 164/35, 45, 369, 516
See application file for complete search history.

(56) References Cited

U.S. PATENT DOCUMENTS

| | | | |
|---|---|---|---|
| 5,092,735 | A | 3/1992 | Katy et al. |
| 5,375,973 | A | 12/1994 | Sloop et al. |
| 7,216,689 | B2 | 5/2007 | Verner et al. |
| 7,258,156 | B2 | 8/2007 | Santeler |
| 2007/0237639 | A1 | 10/2007 | Cunha et al. |
| 2007/0246183 | A1 | 10/2007 | Beals et al. |

*Primary Examiner*—Kuang Lin
(74) *Attorney, Agent, or Firm*—Bachman & LaPointe, P.C.

(57) ABSTRACT

A blade outer air seal (BOAS) casting core has first and second end portions and a plurality of legs. Of these legs, first legs each have: a proximal end joining the first end portion; a main body portion; and a free distal portion. Second legs each have: a proximal end joining the second end portion; a main body portion; and a free distal portion.

20 Claims, 7 Drawing Sheets

BLADE OUTER AIR SEAL CORES AND MANUFACTURE METHODS

BACKGROUND OF THE INVENTION

The invention relates to gas turbine engines. More particularly, the invention relates to casting of cooled shrouds or blade outer air seals (BOAS).

BOAS segments may be internally cooled by bleed air. For example, there may be an upstream-to-downstream array of circumferentially-extending cooling passageway legs within the BOAS. Cooling air may be fed into the passageway legs from the outboard (OD) side of the BOAS (e.g., via one or more inlet ports at ends of the passageway legs). The cooling air may exit the legs through outlet ports in the circumferential ends (matefaces) of the BOAS so as to be vented into the adjacent inter-segment region. The vented air may, for example, help cool adjacent BOAS segments and purge the gap to prevent gas ingestion.

The BOAS segments may be cast via an investment casting process. In an exemplary casting process, a ceramic casting core is used to form the passageway legs. The core has legs corresponding to the passageway legs. The core legs extend between first and second end portions of the core. The core may be placed in a die. Wax may be molded in the die over the core legs to form a pattern. The pattern may be shelled (e.g., a stuccoing process to form a ceramic shell). The wax may be removed from the shell. Metal may be cast in the shell over the core. The shell and core may be destructively removed. After core removal, the core legs leave the passageway legs in the casting. The as-cast passageway legs are open at both circumferential ends of the raw BOAS casting. At least some of the end openings are closed via plug welding, braze pins, or other means. Air inlets to the passageway legs may be drilled from the OD side of the casting.

SUMMARY OF THE INVENTION

One aspect of the invention involves a blade outer air seal (BOAS) casting core. The core has first and second end portions and a plurality of legs. Of these legs, first legs each have: a proximal end joining the first end portion; a main body portion; and a free distal portion. Second legs each have: a proximal end joining the second end portion; a main body portion; and a free distal portion.

In various implementations, the distal portions of the first and second legs may project transverse to the main body portion. The core may be formed of refractory metal sheetstock. The core may have a ceramic coating. The proximal portions may each comprise a reduced cross-section neck. At least one third leg may connect to the first end portion to the second end portion. The at least one third leg may include first and second perimeter or edge legs. A plurality of connector branches may connect adjacent pairs of the legs. The connector branches may have minimum cross-sections smaller than adjacent cross-sections of the connected legs.

The core may be embedded in a shell and a casting cast partially over the core. The first and second end portions of the core may project from the casting into the shell. The first and second leg distal portions may project into the shell or may terminate in the casting.

The core may be manufactured by cutting from a refractory metal sheet. After the cutting, the first and second leg distal portions may be bent transverse to associated main body portions of those legs.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
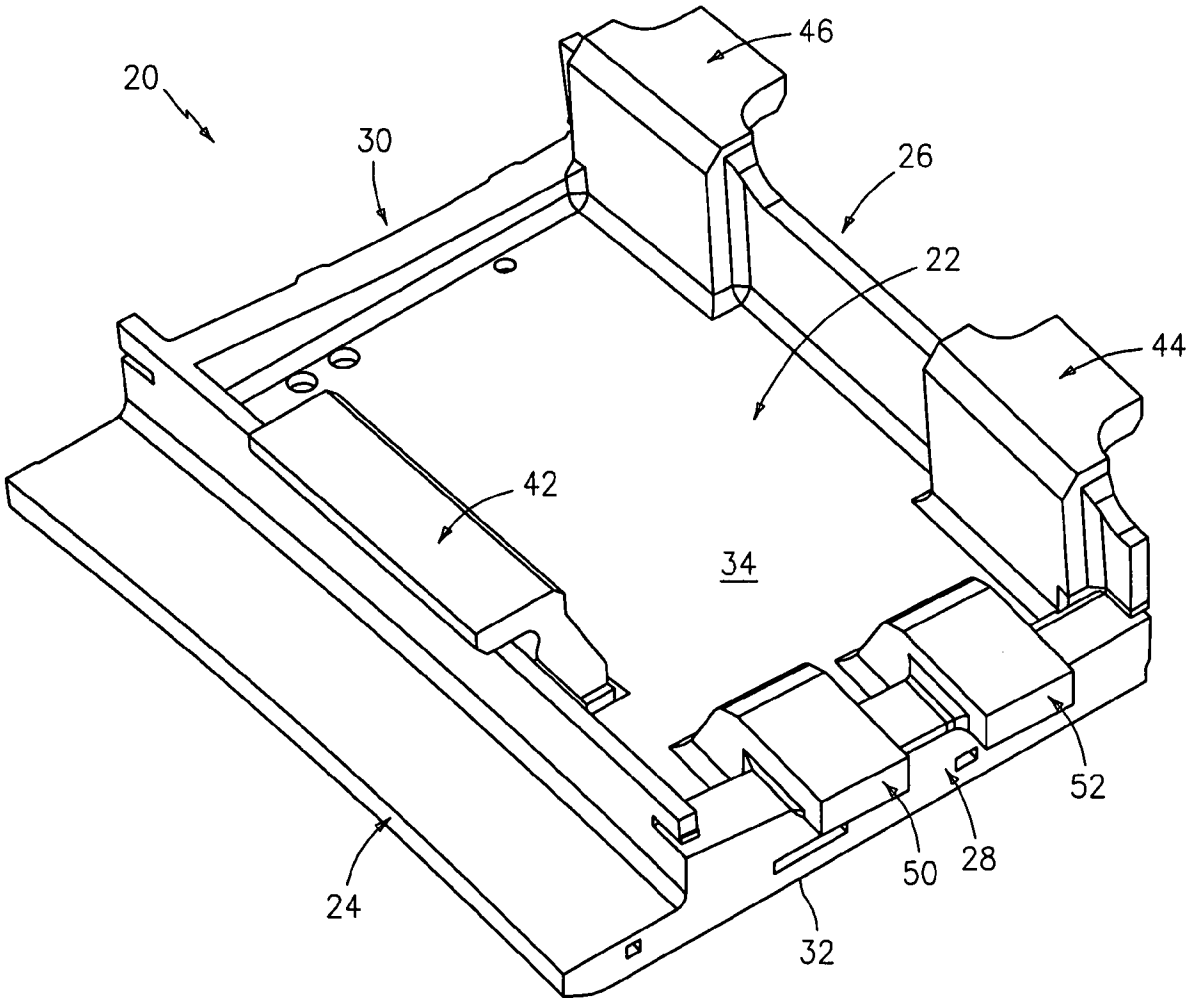
FIG. 1 is a view of a blade outer airseal (BOAS).

FIG. 1 shows blade outer air seal (BOAS) 20. The BOAS has a main body portion 22 having a leading/upstream/forward end 24 and a trailing/downstream/aft end 26. The body has first and second circumferential ends or matefaces 28 and 30. The body has an ID face 32 and an OD face 34. To mount the BOAS to environmental structure 40 (FIG. 3), the exemplary BOAS has a plurality of mounting hooks. The exemplary BOAS has a single central forward mounting hook 42 having a forwardly-projecting distal portion recessed aft of the forward end 24. The exemplary BOAS has a pair of first and second aft hooks 44 and 46 having rearwardly-projecting distal portions protruding aft beyond the aft end 26.

Figure 3:
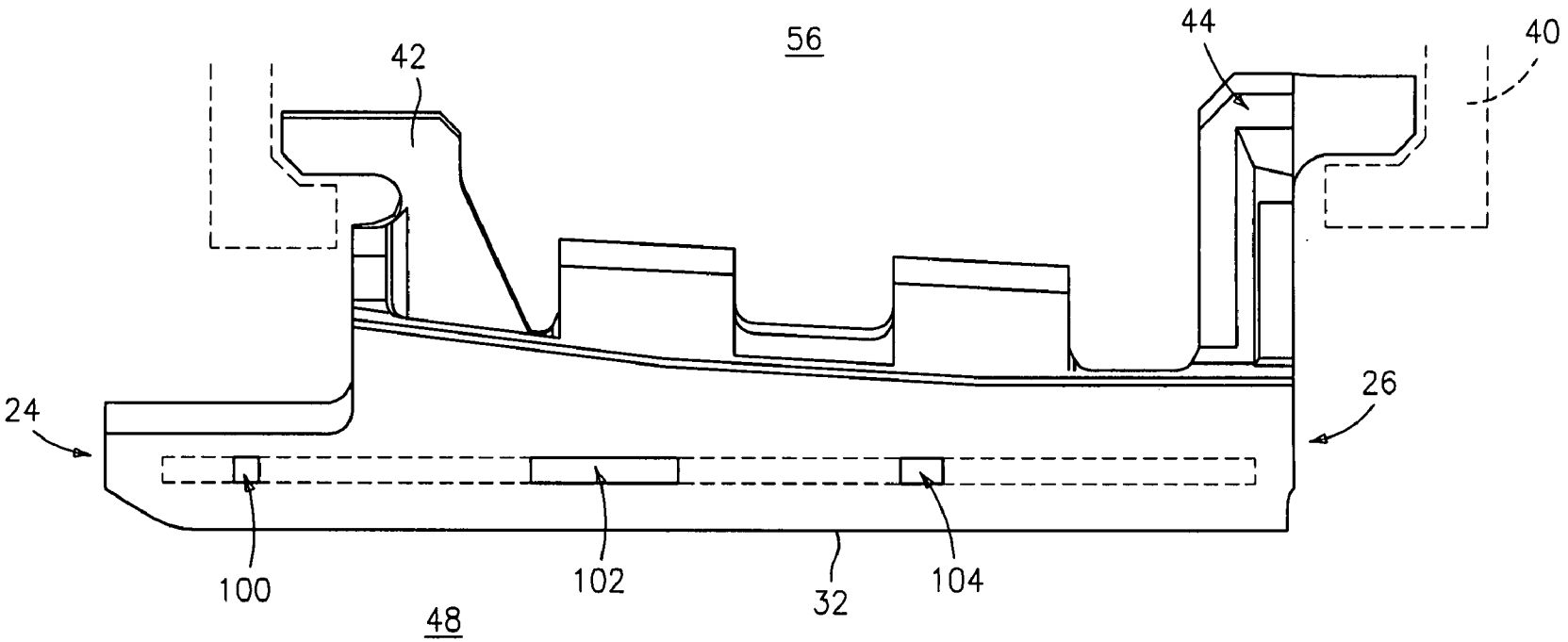
FIG. 3 is a first circumferential end view of the BOAS of FIG. 1.
Figure 4:
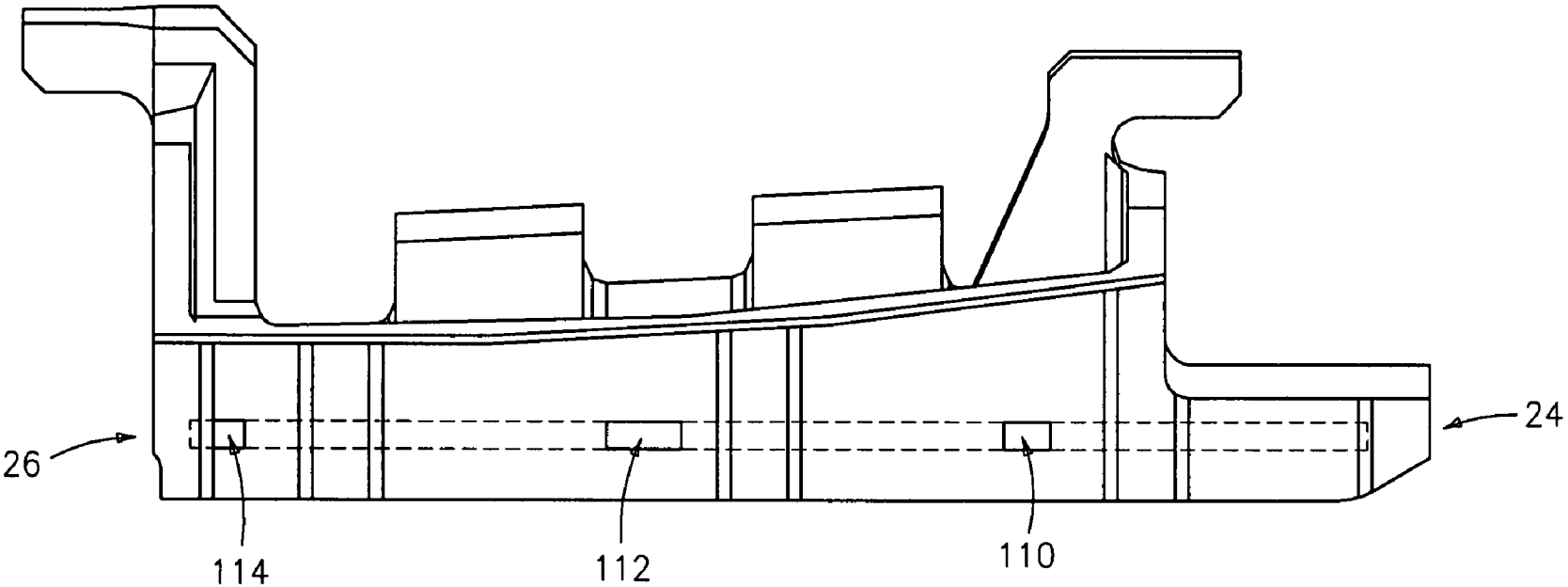
FIG. 4 is a second circumferential end view of the BOAS of FIG. 1.

A circumferential ring array of a plurality of the BOAS 22 may encircle an associated blade stage of a gas turbine engine. The assembled ID faces 32 thus locally bound an outboard extreme of the core flowpath 48 (FIG. 3). The BOAS 22 may have features for interlocking the array. Exemplary features include finger and shiplap joints. The exemplary BOAS 22 has a pair of fore and aft fingers 50 and 52 projecting from the first circumferential end 28 and which, when assembled, radially outboard of the second circumferential end 30 of the adjacent BOAS.

Figure 2:
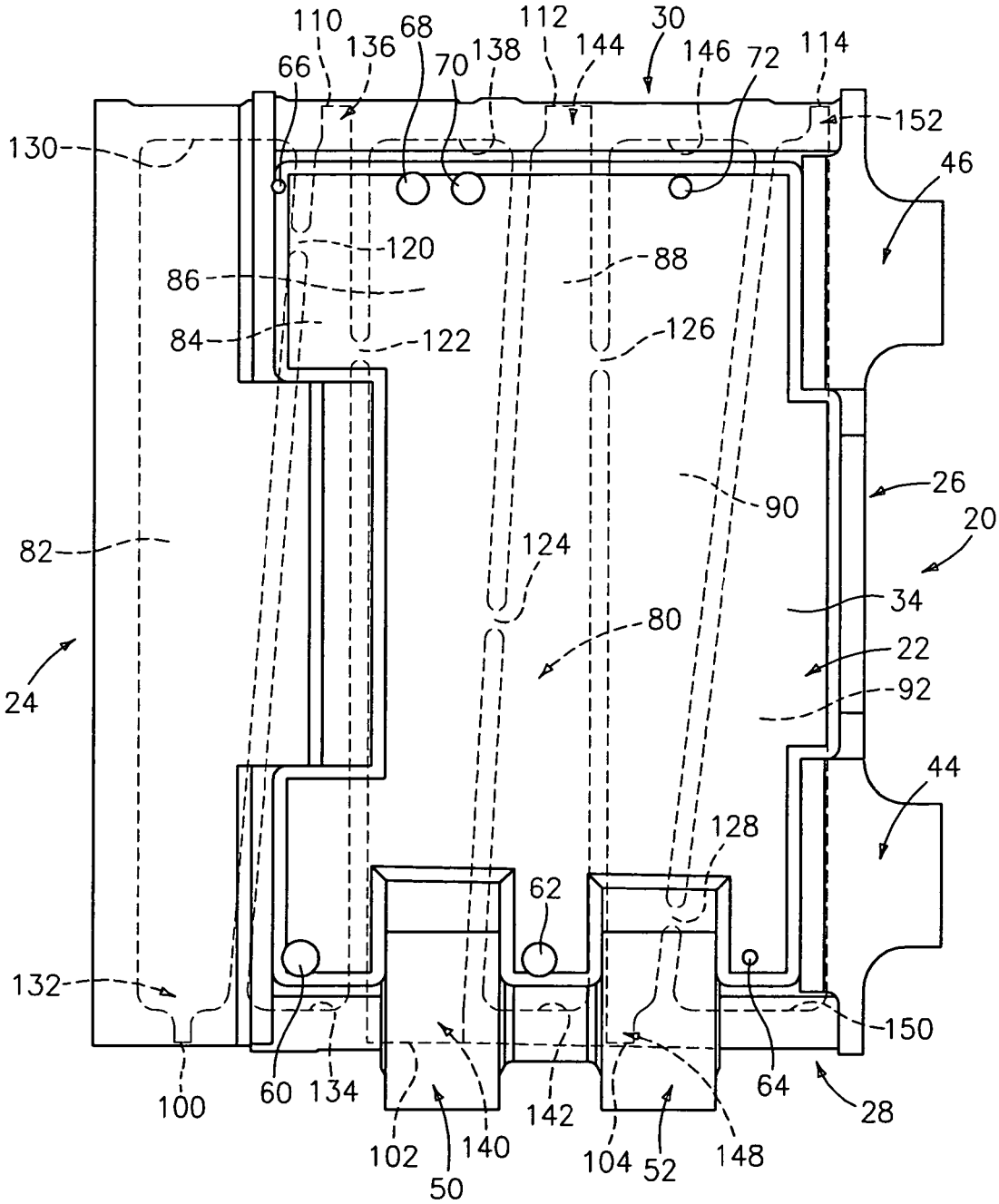
FIG. 2 is an OD/top view of the BOAS of FIG. 1.

The BOAS may be air-cooled. For example, bleed air may be directed to a chamber 56 (FIG. 3) immediately outboard of the face 34. The bleed air may be directed through ports 60, 62, 64, 66, 68, 70, and 72 (FIG. 2) to an internal cooling passageway network 80. The exemplary network includes a plurality of circumferentially-extending legs 82, 84, 86, 88, 90, and 92. The network may have a plurality of outlets. Exemplary outlets may include outlets along the circumferential ends 28 and 30. In the exemplary BOAS 22, outlets 100, 102, and 104 are formed along the first circumferential end 28 and outlets 110, 112, and 114 are formed along the second circumferential end 30. As is discussed in further detail below, adjacent legs may be interconnected by interconnecting passageways 120, 122, 124, 126, and 128.

In operation, the inlet 66 feeds the leg 82 near a closed end 130 of the leg 82. The air flows down the leg 82 to an outlet 100 which is in a neck region at the other end 132 of the leg 82. Similarly, the inlet 60 feeds the leg 84 near a closed end 134. The outlet 110 is at a neck region at the other end 136. The inlets 68 and 70 feed the leg 86 near a closed end 138. The outlet 102 is formed at the other end 140. The inlet 62 feeds the leg 88 near a closed end 142. The outlet 112 is at the other end 144. The inlet 72 feeds the leg 90 near a closed end 146. The outlet 104 is in a neck region at the other end 148. The inlet 64 feeds the leg 92 near a closed end 150. The outlet 114 is formed in a neck region at the other end 152.

Figure 5:
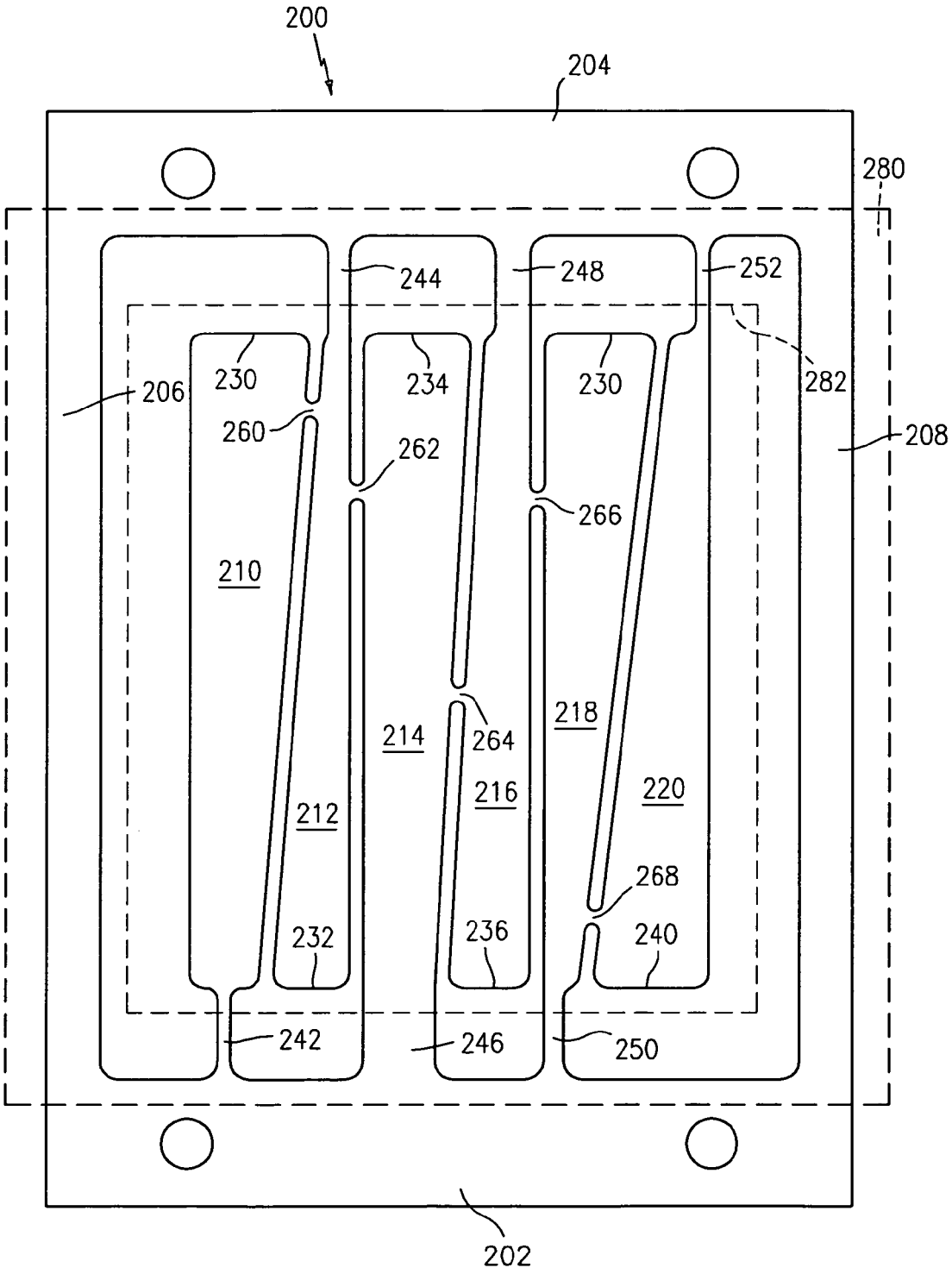
FIG. 5 is a plan view of a refractory metal core (RMC) for casting a cooling passageway network of the BOAS of FIG. 1.

FIG. 5 shows a refractory metal core (RMC) 200 for casting the passageway legs. The core 200 may be cut from a metallic sheet (e.g., of a refractory metal). An exemplary cutting is laser cutting. Alternative cutting may be via a stamping operation. The exemplary RMC 200 has first and second end portions 202 and 204. First and second perimeter legs 206 and 208 extend between and join the end portions 202 and 204 to form a frame-like structure. Between the perimeter legs 206 and 208, there is an array of legs 210, 212, 214, 216, 218, and 220 which respectively cast the passageway legs 82, 84, 86, 88, 90, and 92. In an exemplary implementation, each of the RMC legs has a proximal end joining the adjacent one of the end portions 202 and 204 and a free distal end spaced apart from the other end portion. A main body of the leg extends between the proximal and distal ends. In the exemplary implementation, the core leg distal ends 230, 232, 234, 236, 238, and 240 respectively cast the passageway leg closed ends 130, 134, 138, 142, 146, and 150. The core leg proximal ends 242, 244, 246, 248, 250, and 252 respectively cast the outlets 100, 110, 102, 112, 104, and 114.

By using free distal ends of the RMC legs to cast closed passageway leg ends, the prior art plug welding step can be eliminated or reduced. However, the lack of local connection of the core leg free distal ends to the adjacent core end portion 202 or 204 may compromise structural integrity. To at least partially compensate, the RMC 200 has connecting portions 260, 262, 264, 266, and 268 connecting the main body portions of the adjacent legs. These connecting portions end up casting the passageways 120, 122, 124, 126, and 128, respectively.

From an airflow perspective, the connecting portions may advantageously be positioned at locations along the adjacent legs wherein air pressure in the cast passageway legs will be equal. This may minimize cross-flow and reduce losses. However, such location may provide less-than-desirable RMC strengthening. Thus, the connecting portions may be shifted (e.g., pushed circumferentially outward) relative to the optimal pressure balancing locations.

FIG. 5 also schematically shows a shell 280 having an internal surface 282. The shell 280 is formed over a wax pattern containing the RMC 200 for casting the BOAS. After dewaxing, casting, and deshelling/decoring, the inlets 60, 62, 64, 66, 68, 70, and 72 may be drilled (e.g., as part of a machining process applied to the raw casting).

There may be one or more of several advantages to using the exemplary RMC 200 or modifications thereof. Use of the RMC with free distal leg portions may avoid or reduce the need for plug welding. Use of an RMC relative to a ceramic core may permit the casting of finer passageways. For example, core thickness and passageway height may be reduced relative to those of a baseline ceramic core and its cast passageways. Exemplary RMC thicknesses are less than 1.25 mm, more narrowly, 0.5-11.0 mm. The RMC may also readily be provided with features (e.g., stamped/embossed or laser etched recesses) for casting internal trip strips or other surface enhancements.

Figure 6:
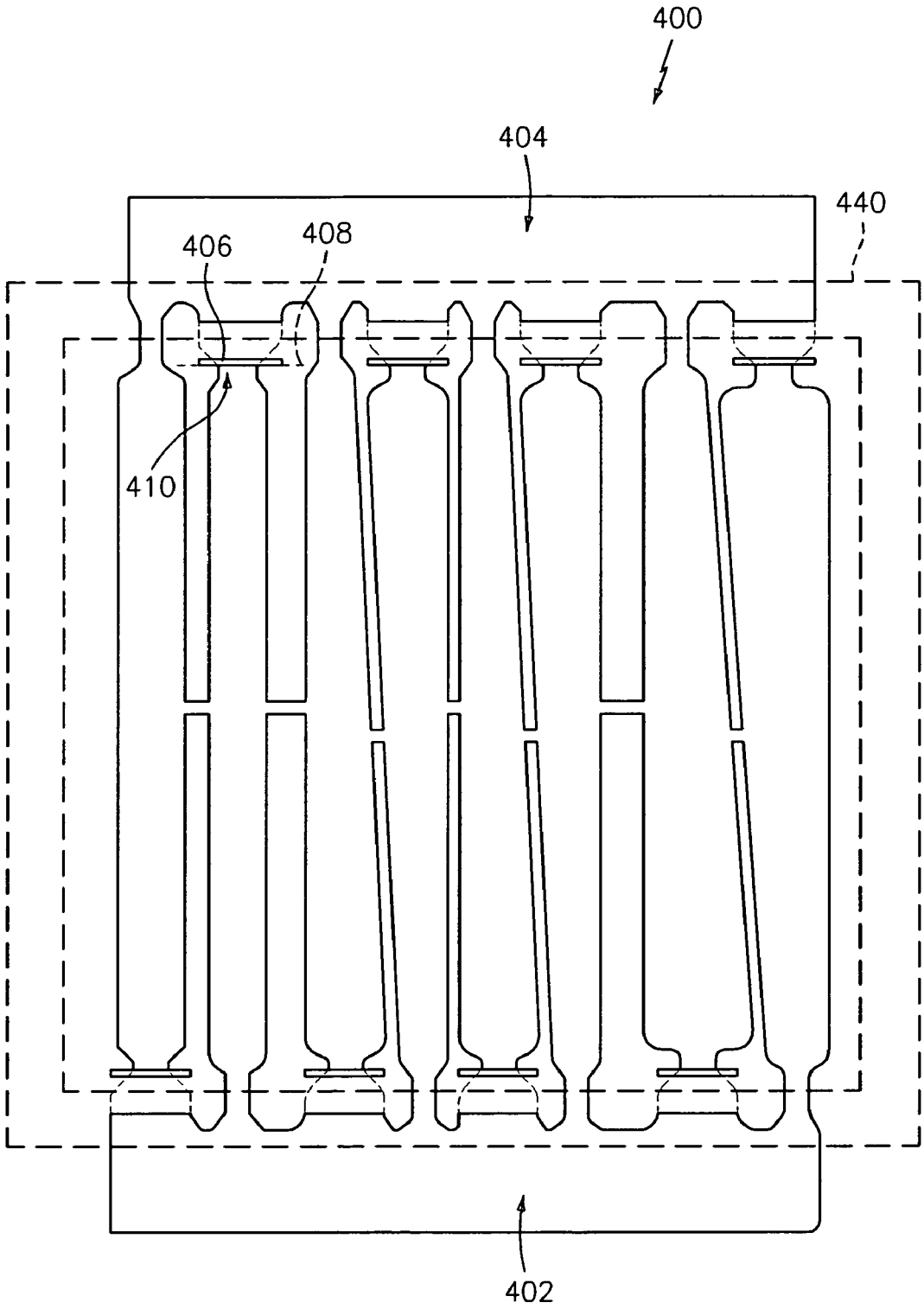
FIG. 6 is a plan view of an alternate RMC.
Figure 7:
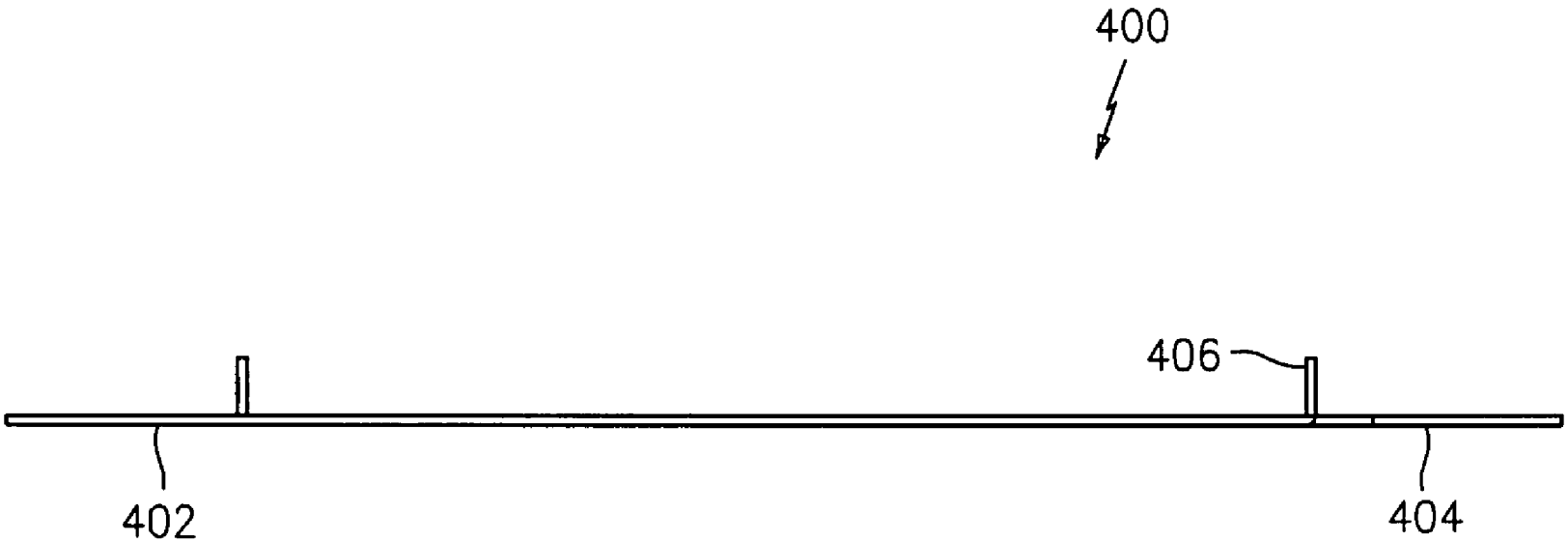
FIG. 7 is a side view of the RMC of FIG. 6.

FIGS. 6 and 7 show an alternate RMC 400 which may also be cut from refractory metal sheetstock. The RMC 400 may be formed otherwise similarly to the RMC 200. The RMC 400 has first and second end portions 402 and 404. A plurality of legs have free distal end portions 406 bent out of the main plane of the RMC. For example, exemplary bends are upwards at bend lines 408 in thinned neck regions 410. After pattern molding, the distal end portions 406 protrude partially from the pattern wax and become embedded in the ultimate shell 440. Relative to use of the RMC 200, this may provide stronger alignment of the RMC in the shell and, thus, more precise passageway positioning. Upon deshelling/decoring, the portion of the distal end portion 406 which had been within the shell cavity leaves a port in the casting. This port may be used as the inlet port. Alternatively, the port could be enlarged (e.g., by drilling or other machining).

Further variations may involve radially constricting one to all of the interconnecting passageways (e.g., 120, 122, 124, 126, and 128) to have a smaller thickness (radial height) than characteristic thickness (e.g., mean, median, or modal) of the adjacent passageway legs. This may be provided by a corresponding thinning of the RMC connecting portions (e.g., 260, 262, 264, 266, and 268). Exemplary thinning may be from one or both RMC faces and may be performed as part of the main cutting of the RMC or later.

One or more embodiments of the present invention have been described. Nevertheless, it will be understood that various modifications may be made without departing from the spirit and scope of the invention. For example, when implemented in the reengineering of a baseline BOAS, or using existing manufacturing techniques and equipment, details of the baseline BOAS or existing techniques or equipment may influence details of any particular implementation. Accordingly, other embodiments are within the scope of the following claims.

What is claimed is:

1. A casting core comprising:
first and second end portions; and
a plurality of legs including:
a plurality of first legs, each having:
a proximal end joining the first end portion;
a main body portion; and
a free distal portion; and
a plurality of second legs, each having:
a proximal end joining the second end portion;
a main body portion; and
a free distal portion.

2. The core of claim 1 wherein:
the distal portions of the first and second legs project transverse to the main body portion.

3. The core of claim 1 wherein:
the core is formed of refractory metal sheetstock.

4. The core of claim 3 wherein:
the core has a ceramic coating.

5. The core of claim 3 wherein:
the sheetstock has a thickness of 0.5-11.0 mm.

6. The core of claim 1 wherein:
the proximal portions of the first and second legs each comprises a reduced cross-section neck.

7. The core of claim 1 further comprising:
at least one third leg connecting the first end portion to the second end portion.

8. The core of claim 7 wherein:
said at least one third leg includes first and second perimeter legs.

9. The core of claim 1 further comprising:
a plurality of connector branches connecting adjacent pairs of said legs and having minimum cross-section smaller than adjacent cross-sections of the connected legs.

10. The core of claim 9 wherein:
the connector branches have smaller thickness than characteristic thickness of the connected legs.

11. A raw casting, shell, and core combination comprising:
shell;
the core of claim 1; and a casting partially over said core, the first and second end portions projecting from the casting into the shell.

12. The combination of claim 11 wherein:

the distal portions of the first and second legs project from the casting into the shell.

13. The combination of claim 11 wherein:

the distal portions of the first and second legs terminate in the casting.

14. A method comprising:

cutting a refractory metal sheet to define:

first and second end portions; and a plurality of legs including:

a plurality of first legs, each having:

a proximal end joining the first end portion;

a main body portion; and a free distal portion; and a plurality of second legs, each having:

a proximal end joining the second end portion;

a main body portion; and a free distal portion; and bending the first and second leg distal portions transverse to the associated main body portion.

15. The method of claim 14 wherein:

the cutting comprises laser cutting.

16. The method of claim 14 wherein:

the cutting comprises:

cutting the first leg distal portions from the second end portion; and cutting the second leg distal portions from the from first end portion.

17. The method of claim 14 further comprising:

applying a coating at least to the first and second leg portions.

18. The method of claim 14 further comprising:

molding a sacrificial material over the first and second leg portions to form a pattern;

shelling the pattern, the first and second end portions and the distal portions projecting from the sacrificial material into the shell;

removing the sacrificial material;

casting metal in the shell; and removing the shell.

19. The method of claim 18 used to form a blade outer air seal and further comprising:

directing air into the seal through inlets cast by the first and second leg distal portions.

20. The method of claim 19 further comprising:

drilling a plurality of outlet holes from a first face of the casting to passageways within the casting cast by the first and second leg portions; and discharging the air through the outlet holes.

* * * * *